US005306053A

United States Patent [19]

Gurusami et al.

[11] Patent Number: 5,306,053

[45] Date of Patent: Apr. 26, 1994

[54] HOOD PROP ROD WITH SECONDARY LATCH

[75] Inventors: Senthil A. Gurusami, Farmington Hills; Ajit K. Desai, Dearborn, both of Mich.

[73] Assignee: Ford Motor Company, Dearborn, Mich.

[21] Appl. No.: 86,295

[22] Filed: Jul. 6, 1993

[51] Int. Cl.[5] ..... E05C 17/10

[52] U.S. Cl. ..... 292/278; 292/338; 292/DIG. 14

[58] Field of Search ..... 292/48, 50, 262, 278, 292/338, DIG. 14, 274

[56] References Cited

U.S. PATENT DOCUMENTS

| | | | |
|---|---|---|---|
| 964,441 | 7/1910 | Lynch . | |
| 1,412,613 | 4/1922 | Henvis . | |
| 1,453,881 | 5/1923 | McClarren . | |
| 1,498,160 | 6/1924 | Ernst . | |
| 1,585,241 | 5/1926 | Grimley . | |
| 1,596,183 | 8/1926 | Horlick, Jr. . | |
| 2,090,473 | 8/1937 | Crabb | 217/60 |
| 2,169,875 | 8/1939 | Fanning | 292/278 X |
| 2,193,111 | 3/1940 | Peterson | 292/214 |
| 2,549,133 | 4/1951 | Scott | 180/69 |
| 2,719,693 | 10/1955 | Penberthy | 248/354 |
| 2,789,635 | 4/1957 | Murphy | 292/278 X |
| 3,315,502 | 4/1967 | Skrapits et al. | 70/240 |
| 3,601,842 | 8/1971 | Morrison | 16/49 |
| 3,743,045 | 7/1973 | Hansen | 180/69 R |
| 4,588,220 | 5/1986 | Matsui et al. | 292/338 |
| 5,040,835 | 8/1991 | Barker | 292/338 |
| 5,112,091 | 5/1992 | Klüting | 292/262 |
| 5,215,074 | 6/1993 | Wilson et al. | 292/338 X |

*Primary Examiner*—Richard E. Moore

*Attorney, Agent, or Firm*—Daniel M. Stock; Roger L. May

[57] ABSTRACT

A hood prop rod assembly 16 which includes a secondary latching assembly 30 mounted upon the housing 32 of a primary hood latch assembly 24. The housing 32 of the hood latch assembly 24 is utilized to pivotally mount a jaw-type latch member 70 for engaging a catcher 28 mounted on a prop rod 26, which extends through the latch housing 32. The primary latch housing 32 is simply modified to provide for passage of the rod 26 through the housing for supporting the rod in the hood open position and for guiding its movement between that position and the closed position.

16 Claims, 3 Drawing Sheets

HOOD PROP ROD WITH SECONDARY LATCH

BACKGROUND OF THE INVENTION

1. Field of the Invention

The present invention relates generally to vehicle engine compartment closure or hoods and more specifically to latching and propping devices therefor.

2. Prior Art

It is the practice in the design of automotive vehicle bodies to provide a closure panel or hood pivotally mounted on vehicle body structure for movement between open and closed positions with respect to the vehicle engine compartment. The hood is normally held fast in its closed position through the use of mechanical latch. It is commonly known to provide a prop in the form of a solid, elongated structure, such as a prop rod, interposed between the hood and portion of the vehicle body adjacent the engine compartment for holding the hood in an open position through selective engagement with a portion of the vehicle hood.

The functions of the prop rod and the latch as well as their structures are generally located separately within the vehicle. It is known, however, to combine the functions of locking and propping in a single assembly. U.S. Pat. No. 2,549,133, assigned to the assignee of the present invention, is an example of such a teaching. The exemplary hood support and lock, however, made use of relatively massive telescoping channel members and required use of a unique locking system. The material outlay is disadvantageous in terms of weight and cost. Further, in the modern automotive industrial environment in which hood latches are extremely well-developed and reliable assemblies, the use of a unique latch mechanism for the purpose of providing the combined latching and propping functions in a single assembly may be ultimately uneconomical.

SUMMARY OF THE INVENTION

Responsive to deficiencies in the prior art, an improved hood prop rod assembly is provided in which the assembly is mounted on the primary hood latch mechanism of the vehicle, extending through its housing and providing a secondary latch mechanism.

According to the invention, the hood prop rod assembly includes a rod extending vertically through the primary hood latch housing of the vehicle which has one end pivotally connected to the hood, and an opposite end engageable with a portion of the latch housing. A catcher member is carried on the rod, and a second latch assembly is mounted on the latch housing for receiving the catcher member in latching engagement when the hood is in the closed position.

The hood prop rod assembly of the present invention further includes a guide carried on the latch housing and guidingly the receiving the prop rod through it.

BRIEF DESCRIPTION OF THE DRAWINGS

The foregoing aspects of the present invention as well as other objects and features related thereto will become apparent to those skilled in the automotive body art by reading the following description with reference to the accompanying drawing, in which.

DESCRIPTION OF THE PREFERRED EMBODIMENT

Figure 1:
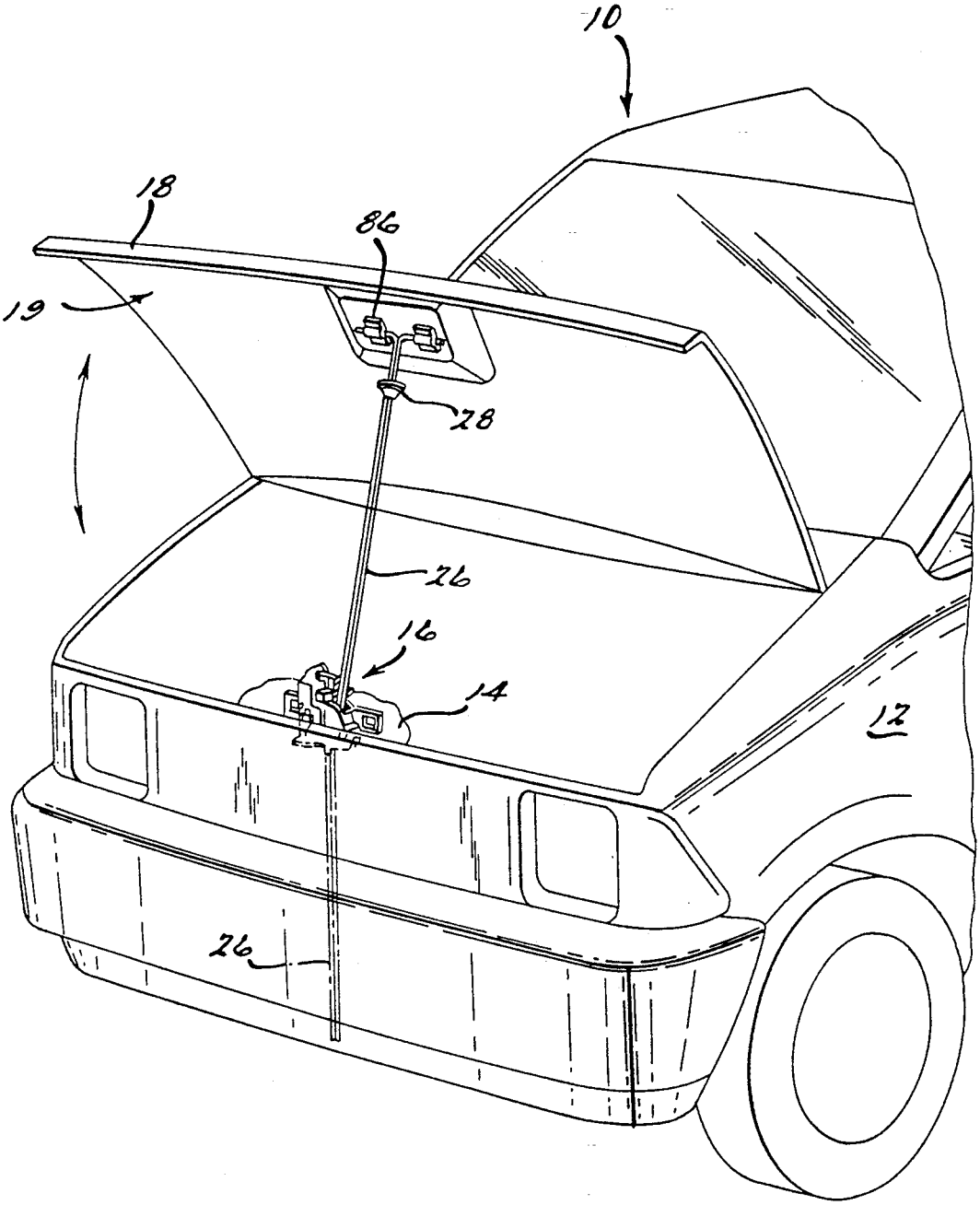
FIG. 1 is a perspective view of the front portion of an automotive vehicle employing the hood prop rod assembly of the present invention.

Turning now to the drawings, and particularly to FIG. 1 thereof, an automotive vehicle 10 is illustrated as having a body indicated generally at 12 including an interior support surface, such as indicated by the numeral 14, for mounting a hood prop rod assembly 16 according to the present invention. The hood prop rod assembly 16 is operatively engaged with a hood 18 which is pivotally mounted through conventional hinges (not shown) for movement between the open position shown and a closed position in the direction of the double-headed arrow indicated at 20. In the closed position, the hood 18 covers the aperture 22 through which access is provided to the engine (not shown) of the vehicle 10.

Figure 2:
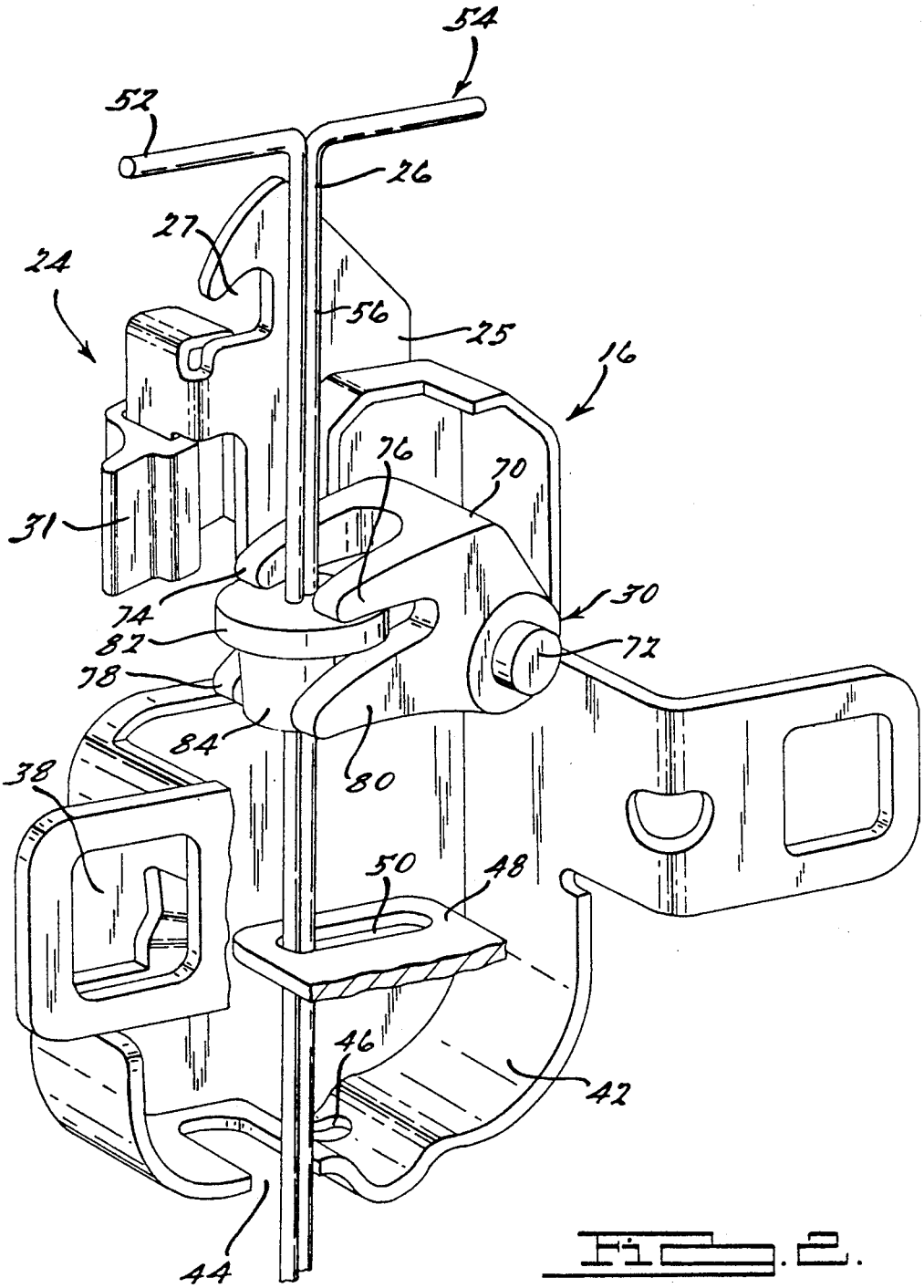
FIG. 2 is an enlarged perspective view of the hood prop rod assembly of the present invention with operative components illustrated in a closed position.
Figure 3:
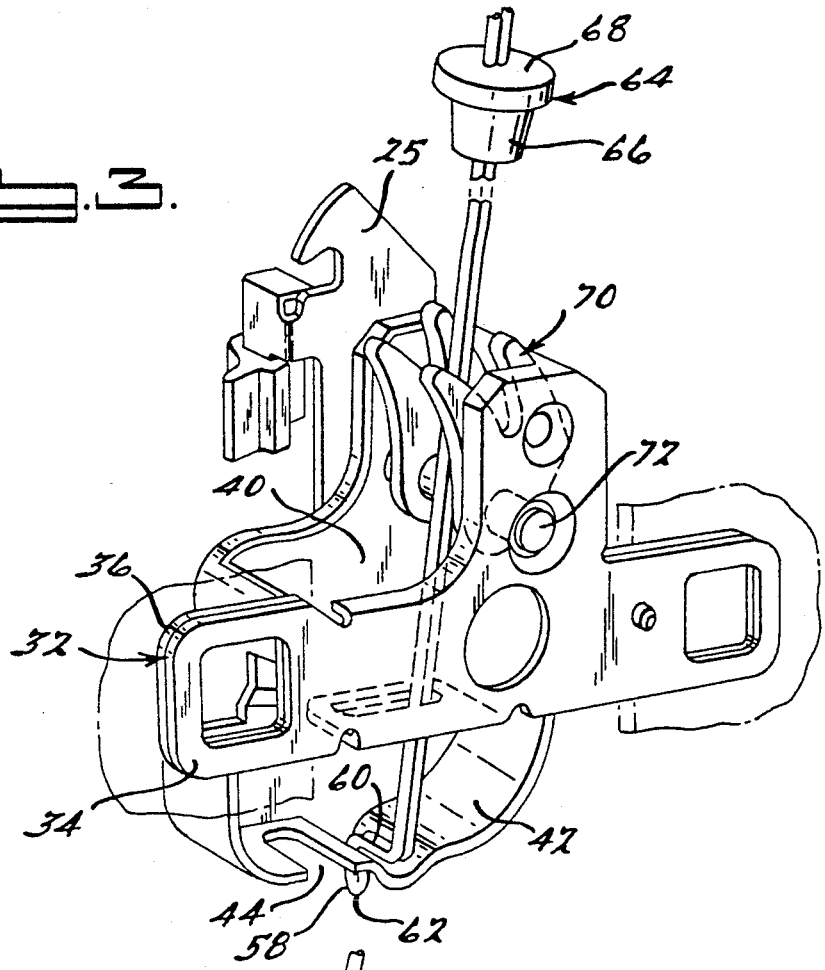
FIG. 3 is a perspective view similar to FIG. 2 showing parts in the open position.
Figure 4:
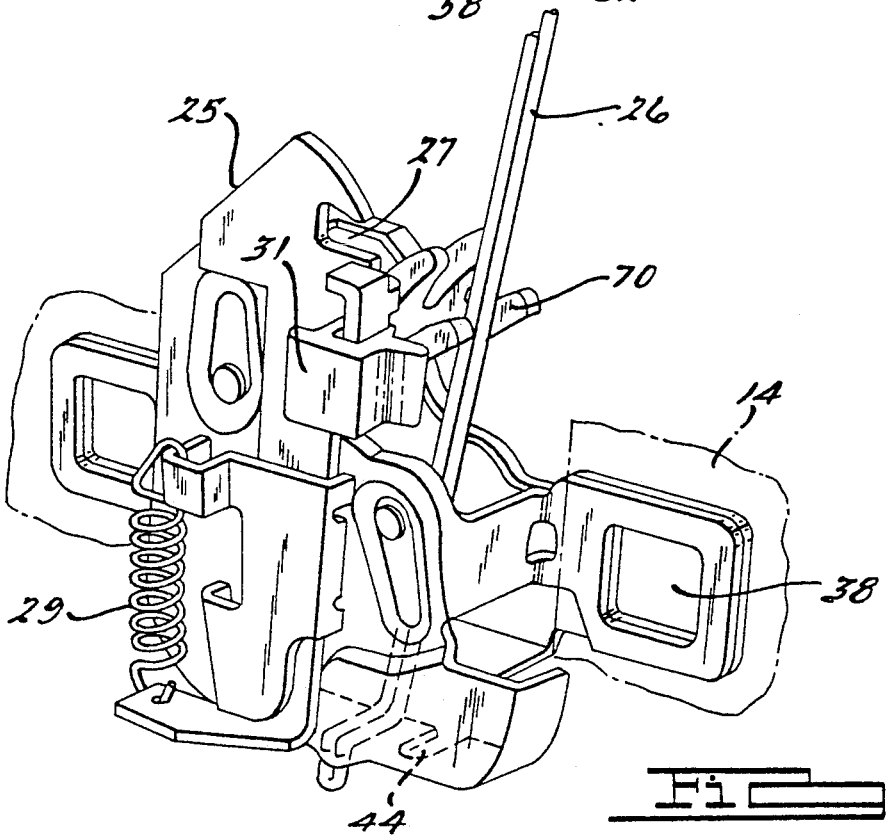
FIG. 4 is a rear perspective view of FIG. 3.

Turning next to FIGS. 2–4, the hood prop rod assembly 16 comprises, generally, a primary latch assembly 24 for the vehicle 10, a prop rod 26, a catcher 28 carried on the prop rod 26, and a secondary latch assembly 30 operatively carried with the primary latch assembly 24.

The primary latch assembly 24 is a conventional design utilized by Ford Motor Company, the assignee of the present invention, in certain of its production vehicles. The illustrated design is that employed in the minivans manufactured and sold under the trademark AEROSTAR. The precise design of the primary latch 24, however, is unimportant to the understanding or use of the hood prop rod assembly 26 of the present invention, except that the structure of the latch assembly must accommodate operation with the unique prop rod catcher 28 and secondary latch mechanism 30 consistent with operation to be herein described.

The primary latch assembly 24 is illustrated as having a housing 32 which is formed of a pair of stampings secured together, including a rear plate 34 and a front plate 36. Apertures 38 formed through the plates 34, 36 are provided for receiving suitable fasteners (not shown) for securing the latch assembly 24 to the support portion 14 of the vehicle body 10, the support portion 14 typically being a radiator support beam. In the illustrated embodiment, the plates 34, 36 define a cup-like opening 40 and the front plate 36 includes a longitudinally extending support wall 42. A pair of blind slots are formed through the support wall 42 in laterally spaced adjacent relationship. One of the slots 44, designated an access slot, is substantially laterally wider than the other slot 46.

Also in the illustrated embodiment, a guide plate 48 is bent or struck over from the rear plate 34 to present a laterally extending guide slot 50 for receiving the prop rod 26. It will be understood that the guide plate 48 need not be integrally formed with the plate 34.

As may best be seen in FIG. 4, the latch assembly 24 further includes a primary latch member 25 which includes a hook-like aperture 27 for engagement with a conventional striker (not shown) fixedly mounted to the underside of the hood 18 for locking engagement therewith. The latch member 25 is pivotally mounted to the housing 32 in a well-known manner, but does not form part of the present invention; and it is resiliently urged through a spring 29 to the latched position from which it may be displaced by agency of a manual actuator indicated at 31.

The prop rod 26 is illustrated as being simply fabricated from a continuously bent wire 52 to define a laterally extending T-shaped top portion 54, a vertically extending support section 56, and an L-shaped bent portion 58 which includes a horizontal portion 60 engageable in support relationship against the support wall 42 of the front plate 36, and a vertical portion 62 engageable in abutting relationship against the terminal end of the slot 46 to restrain the prop rod 26 against movement in that direction when so positioned for support in the open position illustrated in FIG. 3.

The catcher member 28 is illustrated as comprising a stepped cylindrical member 64 which has a tapered lower section 66 and an enlarged diameter upper section 68. The catcher member 28 is fixedly secured in surrounding relationship on the prop rod 26, for example, by molding a thermoplastic part in the shape of the catcher around the prop rod 26 or by other suitable means.

As may best be seen in FIG. 2, the secondary latch assembly 30 comprises a jaw member 70 pivotally mounted on the housing 32 as by a pin 72. The jaw member 70 includes a longitudinally spaced pair of upper locking arms 74, 76 and a bottom pair of longitudinally spaced locking arms 78, 80.

When the hood 18 is in the closed position, the catcher member 28 is latchingly received within the latch assembly 30 with upper locking arms 74, 76 engaging an upper surface 82 of the enlarged portion 68 of the catcher member, and lower locking arm 78, 80 engaging a lower annular surface 84 of enlarged portion 68 of the catcher member 28.

The hood prop rod assembly of the present invention is assembled with respect to the vehicle by mounting the prop rod 26 pivotally with respect to the underside 19 of the hood 18 as by mounting the T-shaped section 54 in a pair of spaced trunnions, indicated generally at 86. The prop rod 26 is then inserted through the aperture 40 in the housing 32 of the primary latch assembly 24. To allow closure of the hood position shown in FIG. 2, the rod 26 passes through the access slot 44 to depend vertically downward, as is shown in phantom in FIG. 1. When in the closed position, both the primary and the secondary latch mechanisms are in their locked position. The secondary latch assembly 30 may be resiliently urged and held toward the latch position and there held fast through conventional mechanisms. Such routine additions to the structure here disclosed are not intended to form a part of the present invention.

Upon releasing the latch mechanisms, the hood may be pivoted upwardly toward the position shown in FIG. 1, and movement of the enlarged portion 68 of the catcher 28 against the upper arms 74, 76 of the jaw 70 effects pivoting movement of the jaw 70 to the position best shown in FIGS. 2 and 3. Full movement to the upward position draws the rod 26 and its bent end portion 58 through the access hole 44, whereupon the rod may be manipulated to engage in the access slot 46, as illustrated in FIGS. 2 and 3, providing the full, open support illustrated in FIG. 1.

One embodiment of the hood prop rod assembly has been disclosed; others will be possible without departing from the scope of the appended claims.

What is claimed is:

1. A hood prop rod assembly for an automotive vehicle body having a latch assembly operatively carried between a hood panel pivotally mounted on a first mounting surface of the body for movement between an open and a closed position and a second mounting surface of the body longitudinally spaced from the first mounting surface, the latch assembly including a housing mounted on the second mounting surface, comprising:

a rod extending vertically through the latch housing and having one end pivotally connected to the hood and an opposed end engageable with a support portion of latch housing to support the hood in the open position;

a catcher member carried on the rod at a certain position intermediate its ends; and a second latch assembly mounted on the latch housing and operative to receive the catcher member in latching engagement when the hood is in the closed position.

2. A hood prop rod assembly as defined in claim 1 and further comprising guide means carried on the latch housing vertically spaced from the second latch assembly and having a guide aperture receiving the rod therethrough.

3. A hood prop rod assembly as defined in claim 1 and further comprising means defining an L-shaped bent portion at the rod opposed end, engageable with the latch housing support portion.

4. A hood prop rod assembly as defined in claim 3, and further comprising a longitudinally extending support slot, formed through the latch housing support portion, for receiving the L-shaped bent portion of the rod.

5. A hood prop rod assembly as defined in claim 4 and further comprising a clearance slot formed through the latch housing adjacent to and laterally spaced from the support slot.

6. A hood prop rod assembly as defined in claim 5, wherein the guide aperture comprises a laterally extending slot operative to permit selective lateral movement of the rod between positions aligned with the support slot and the access slot.

7. A hood prop rod assembly as defined in claim 1, wherein the catcher member comprises a cylindrical member having an enlarged diameter portion at one end thereof and receiving the rod axially therethrough.

8. A hood prop rod assembly as defined in claim 7, wherein the second latch assembly comprises a jaw member typically mounted on the latch housing and having upper and lower locking legs engaging the catcher member large diameter portion therebetween when the hood is in closed position.

9. A hood prop rod assembly as defined in claim 3, wherein the guide means comprises a lower stop surface overlying the L-shaped bent portion to limit upward movement of the prop rod.

10. A hood prop rod assembly as defined in claim 3, wherein the guide member is positioned vertically below the second latch assembly.

11. A hood prop rod assembly for an automotive vehicle body having a latch assembly operatively carried between a hood panel pivotally mounted on a first mounting surface of the body for movement between an open and a closed position and a second mounting surface of the body longitudinally spaced from the first mounting surface, the latch assembly including a housing mounted on the second mounting surface, comprising:

a rod extending vertically through the latch housing and having one end pivotally connected to the hood and an opposed end engageable with the support portion of latch housings to support the hood in the open position;

a cylindrical catcher member having an enlarged diameter portion at one end thereof, carried on the rod at a certain position intermediate its ends; and a secondary latch assembly having a jaw member typically mounted on the latch housing, and having upper and lower locking legs engaging the catcher member large diameter portion therebetween when the hood is in the closed position.

12. A hood prop rod assembly as defined in claim 11, and further comprising guide means carried on the latch housing vertically spaced from the second latch assembly and having a guide aperture receiving the rod therethrough.

13. A hood prop rod assembly as defined in claim 11 and further comprising means defining an L-shaped bent portion at the rod opposed end, engageable with the latch housing support portion.

14. A hood prop rod assembly as defined in claim 13 and further comprising a longitudinally extending support slot, formed through the latch housing support portion, for receiving the L-shaped bent portion of the rod.

15. A hood prop rod assembly as defined in claim 14 and further comprising a clearance slot formed through the latch housing adjacent to and laterally spaced from the support slot.

16. A hood prop rod assembly as defined in claim 15, wherein the guide aperture comprises a laterally extending slot operative to permit selective lateral movement of the rod between positions aligned with the support slot and the access slot.

* * * * *